US009734836B2

(12) United States Patent
Liu et al.

(10) Patent No.: US 9,734,836 B2
(45) Date of Patent: Aug. 15, 2017

(54) METHOD AND APPARATUS FOR DECODING SPEECH/AUDIO BITSTREAM

(71) Applicant: Huawei Technologies Co., Ltd., Shenzhen (CN)

(72) Inventors: Zexin Liu, Beijing (CN); Xingtao Zhang, Beijing (CN); Lei Miao, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/197,364

(22) Filed: Jun. 29, 2016

(65) Prior Publication Data

US 2016/0343382 A1 Nov. 24, 2016

Related U.S. Application Data

(63) Continuation of application No. PCT/CN2014/081635, filed on Jul. 4, 2014.

(30) Foreign Application Priority Data

Dec. 31, 2013 (CN) ..... 2013 1 0751997

(51) Int. Cl.
*G10L 19/00* (2013.01)
*G10L 21/00* (2013.01)
(Continued)

(52) U.S. Cl.
CPC ..... *G10L 19/167* (2013.01); *G10L 19/005* (2013.01); *G10L 19/06* (2013.01); *G10L 2019/0002* (2013.01); *G10L 2025/932* (2013.01)

(58) Field of Classification Search
None
See application file for complete search history.

(56) References Cited

U.S. PATENT DOCUMENTS 4,731,846 A * 3/1988 Secrest ..... G10L 25/90 704/207
5,615,298 A * 3/1997 Chen ..... G10L 19/005 704/201
(Continued)

FOREIGN PATENT DOCUMENTS

CN 1787078 A 6/2006
CN 101261836 A 9/2008
(Continued)

OTHER PUBLICATIONS

Partial English Translation and Abstract of Chinese Patent Application No. CN101777963, Jul. 14, 2010, 4 pages.
(Continued)

*Primary Examiner* — Edgar Guerra-Erazo
(74) *Attorney, Agent, or Firm* — Conley Rose, P.C.

(57) ABSTRACT

A method and an apparatus for decoding a speech/audio bitstream are disclosed, where the method for decoding a speech/audio bitstream includes determining whether a current frame is a normal decoding frame or a redundancy decoding frame, obtaining a decoded parameter of the current frame by means of parsing when the current frame is a normal decoding frame or a redundancy decoding frame, performing post-processing on the decoded parameter of the current frame to obtain a post-processed decoded parameter of the current frame, and using the post-processed decoded parameter of the current frame to reconstruct a speech/audio signal.

16 Claims, 3 Drawing Sheets

(51) Int. Cl.

| | |
|---|---|
| ***G10L 13/00*** | (2006.01) |
| ***G10L 19/16*** | (2013.01) |
| ***G10L 19/005*** | (2013.01) |
| ***G10L 19/06*** | (2013.01) |
| *G10L 25/93* | (2013.01) |

(56) References Cited

U.S. PATENT DOCUMENTS

| | | | | |
|---|---|---|---|---|
| 5,699,478 | A * | 12/1997 | Nahumi | G10L 19/005 704/226 |
| 5,717,824 | A * | 2/1998 | Chhatwal | G10L 19/12 704/219 |
| 5,907,822 | A * | 5/1999 | Prieto, Jr. | G10L 19/005 704/202 |
| 6,385,576 | B2 * | 5/2002 | Amada | G10L 19/10 704/219 |
| 6,597,961 | B1 * | 7/2003 | Cooke | G10L 19/005 700/94 |
| 6,665,637 | B2 * | 12/2003 | Bruhn | G10L 19/005 704/200.1 |
| 6,952,668 | B1 * | 10/2005 | Kapilow | G10L 19/005 341/94 |
| 6,973,425 | B1 * | 12/2005 | Kapilow | G10L 19/005 375/316 |
| 7,031,926 | B2 * | 4/2006 | Makinen | G10L 19/005 704/500 |
| 7,047,187 | B2 * | 5/2006 | Cheng | G10L 19/018 704/200.1 |
| 7,529,673 | B2 * | 5/2009 | Makinen | G10L 19/005 704/200 |
| 7,590,525 | B2 * | 9/2009 | Chen | G10L 19/005 704/211 |
| 8,364,472 | B2 * | 1/2013 | Ehara | G10L 19/09 381/93 |
| 2002/0091523 | A1 * | 7/2002 | Makinen | G10L 19/005 704/258 |
| 2004/0117178 | A1 * | 6/2004 | Ozawa | G10L 19/10 704/230 |
| 2006/0088093 | A1 | 4/2006 | Lakaniemi et al. | |
| 2006/0173687 | A1 * | 8/2006 | Spindola | G10L 19/005 704/265 |
| 2007/0239462 | A1 * | 10/2007 | Makinen | G10L 19/005 704/500 |
| 2007/0271480 | A1 * | 11/2007 | Oh | G10L 19/005 714/3 |
| 2009/0248404 | A1 | 10/2009 | Ehara et al. | |
| 2010/0115370 | A1 | 5/2010 | Laaksonen et al. | |
| 2013/0028409 | A1 | 1/2013 | Li et al. | |

FOREIGN PATENT DOCUMENTS

| | | | |
|---|---|---|---|
| CN | 101777963 | A | 7/2010 |
| CN | 102438152 | A | 5/2012 |
| CN | 102726034 | A | 10/2012 |
| CN | 103366749 | A | 10/2013 |
| EP | 2017829 | A2 | 1/2009 |
| WO | 2008007696 | A1 | 1/2008 |
| WO | 2012158159 | A1 | 11/2012 |
| WO | 2013109956 | A1 | 7/2013 |

OTHER PUBLICATIONS

Partial English Translation and Abstract of Chinese Patent Application No. CN101261836, Sep. 10, 2008, 10 pages.

Foreign Communication From a Counterpart Application, Chinese Application No. 201310751997.X, Chinese Search Report dated Oct. 23, 2015, 7 pages.

Foreign Communication From a Counterpart Application, European Application No. 14876788.2, Extended European Search Report dated Nov. 22, 2016, 8 pages.

Foreign Communication From A Counterpart Application, PCT Application No. PCT/CN2014/081635, English Translation of International Search Report dated Sep. 30, 2014, 3 pages.

Foreign Communication From A Counterpart Application, PCT Application No. PCT/CN2014/081635, English Translation of Written Opinion dated Sep. 30, 2014, 8 pages.

"Series G: Transmission Systems and Media, Digital Systems and Network, Digital Terminal Equipments—Coding of Voice and Audio Signals, Frame Error Robust Narrow-Band and Wideband Embedded Variable Bit-Rate Coding of Speech and Audio from 8-32 kbit/s," ITU-T, G.718, Jun. 2008, 257 pages.

Foreign Communication From A Counterpart Application, Korean Application No. 10-2016-7018932, Korean Office Action dated Jun. 5, 2017, 7 pages.

Foreign Communication From A Counterpart Application, Korean Application No. 10-2016-7018932, English Translation of Korean Office Action dated Jun. 5, 2017, 4 pages.

* cited by examiner

METHOD AND APPARATUS FOR DECODING SPEECH/AUDIO BITSTREAM

CROSS-REFERENCE TO RELATED APPLICATIONS

This application is a continuation of International Application No. PCT/CN2014/081635, filed on Jul. 4, 2014, which claims priority to Chinese Patent Application No. 201310751997.X, filed on Dec. 31, 2013, both of which are hereby incorporated by reference in their entireties.

TECHNICAL FIELD

The present application relates to audio decoding technologies, and in particular, to a method and an apparatus for decoding a speech/audio bitstream.

BACKGROUND

In a mobile communications service, due to a packet loss and delay variation on a network, it is inevitable to cause a frame loss, resulting in that some speech/audio signals cannot be reconstructed using a decoded parameter and can be reconstructed only using a frame erasure concealment (FEC) technology. However, in a case of a high packet loss rate, if only the FEC technology at a decoder side is used, a speech/audio signal that is output is of relatively poor quality and cannot meet the need of high quality communication.

To better resolve a quality degradation problem caused by a speech/audio frame loss, a redundancy encoding algorithm is generated. At an encoder side, in addition to that a particular bit rate is used to encode information about a current frame, a lower bit rate is used to encode information about another frame than the current frame, and a bitstream at a lower bit rate is used as redundant bitstream information and transmitted to a decoder side together with a bitstream of the information about the current frame. At the decoder side, when the current frame is lost, if a jitter buffer or a received bitstream stores the redundant bitstream information containing the current frame, the current frame can be reconstructed according to the redundant bitstream information in order to improve quality of a speech/audio signal that is reconstructed. The current frame is reconstructed based on the FEC technology only when there is no redundant bitstream information of the current frame.

It can be known from the above that, in the existing redundancy encoding algorithm, redundant bitstream information is obtained by means of encoding using a lower bit rate, and therefore, signal instability may be caused, resulting in that quality of a speech/audio signal that is output is not high.

SUMMARY

Embodiments of the present application provide a redundancy decoding method and apparatus for a speech/audio bitstream, which can improve quality of a speech/audio signal that is output.

According to a first aspect, a method for decoding a speech/audio bitstream is provided, including determining whether a current frame is a normal decoding frame or a redundancy decoding frame, obtaining a decoded parameter of the current frame by means of parsing if the current frame is a normal decoding frame or a redundancy decoding frame, performing post-processing on the decoded parameter of the current frame to obtain a post-processed decoded parameter of the current frame, and using the post-processed decoded parameter of the current frame to reconstruct a speech/audio signal.

With reference to the first aspect, in a first implementation manner of the first aspect, the decoded parameter of the current frame includes a spectral pair parameter of the current frame and performing post-processing on the decoded parameter of the current frame includes using the spectral pair parameter of the current frame and a spectral pair parameter of a previous frame of the current frame to obtain a post-processed spectral pair parameter of the current frame.

With reference to the first implementation manner of the first aspect, in a second implementation manner of the first aspect, the post-processed spectral pair parameter of the current frame is obtained through calculation by further using the following formula:

$$lsp[k]=\alpha*\text{lsp_old}[k]+\delta*\text{lsp_new}[k]\ 0\le k\le M,$$

where lsp[k] is the post-processed spectral pair parameter of the current frame, lsp_old[k] is the spectral pair parameter of the previous frame, lsp_new[k] is the spectral pair parameter of the current frame, M is an order of spectral pair parameters, $\alpha$ is a weight of the spectral pair parameter of the previous frame, and $\delta$ is a weight of the spectral pair parameter of the current frame, where $\alpha\ge 0$, $\delta\ge 0$, and $\alpha+\delta=1$.

With reference to the first implementation manner of the first aspect, in a third implementation manner of the first aspect, the post-processed spectral pair parameter of the current frame is obtained through calculation using the following formula:

$$lsp[k]=\alpha*\text{lsp_old}[k]+\beta*\text{lsp_mid}[k]+\delta*\text{lsp_new}[k]\quad 0\le k\le M,$$

where lsp[k] is the post-processed spectral pair parameter of the current frame, lsp_old[k] is the spectral pair parameter of the previous frame, lsp_mid [k] is a middle value of the spectral pair parameter of the current frame, lsp_new[k] is the spectral pair parameter of the current frame, M is an order of spectral pair parameters, $\alpha$ is a weight of the spectral pair parameter of the previous frame, $\beta$ is a weight of the middle value of the spectral pair parameter of the current frame, and $\delta$ is a weight of the spectral pair parameter of the current frame, where $\alpha\ge 0$, $\beta\ge 0$, $\delta\ge 0$, and $\alpha+\beta+\delta=1$.

With reference to the third implementation manner of the first aspect, in a fourth implementation manner of the first aspect, when the current frame is a redundancy decoding frame and the signal class of the current frame is not unvoiced, if the signal class of the next frame of the current frame is unvoiced, or the spectral tilt factor of the previous frame of the current frame is less than the preset spectral tilt factor threshold, or the signal class of the next frame of the current frame is unvoiced and the spectral tilt factor of the previous frame of the current frame is less than the preset spectral tilt factor threshold, a value of $\beta$ is 0 or is less than a preset threshold.

With reference to any one of the second to the fourth implementation manners of the first aspect, in a fifth implementation manner of the first aspect, when the signal class of the current frame is unvoiced, the previous frame of the current frame is a redundancy decoding frame, and a signal class of the previous frame of the current frame is not unvoiced, a value of $\alpha$ is 0 or is less than a preset threshold.

With reference to any one of the second to the fifth implementation manners of the first aspect, in a sixth implementation manner of the first aspect, when the current frame is a redundancy decoding frame and the signal class of the current frame is not unvoiced, if the signal class of the next frame of the current frame is unvoiced, or the spectral tilt factor of the previous frame of the current frame is less than the preset spectral tilt factor threshold, or the signal class of the next frame of the current frame is unvoiced and the spectral tilt factor of the previous frame of the current frame is less than the preset spectral tilt factor threshold, a value of $\delta$ is 0 or is less than a preset threshold.

With reference to any one of the fourth or the sixth implementation manners of the first aspect, in a seventh implementation manner of the first aspect, the spectral tilt factor may be positive or negative, and a smaller spectral tilt factor indicates a signal class, which is more inclined to be unvoiced, of a frame corresponding to the spectral tilt factor.

With reference to the first aspect or any one of the first to the seventh implementation manners of the first aspect, in an eighth implementation manner of the first aspect, the decoded parameter of the current frame includes an adaptive codebook gain of the current frame, and when the current frame is a redundancy decoding frame, if the next frame of the current frame is an unvoiced frame, or a next frame of the next frame of the current frame is an unvoiced frame and an algebraic codebook of a current subframe of the current frame is a first quantity of times an algebraic codebook of a previous subframe of the current subframe or an algebraic codebook of the previous frame of the current frame, performing post-processing on the decoded parameter of the current frame includes attenuating an adaptive codebook gain of the current subframe of the current frame.

With reference to the first aspect or any one of the first to the seventh implementation manners of the first aspect, in a ninth implementation manner of the first aspect, the decoded parameter of the current frame includes an adaptive codebook gain of the current frame, and when the current frame or the previous frame of the current frame is a redundancy decoding frame, if the signal class of the current frame is generic and the signal class of the next frame of the current frame is voiced or the signal class of the previous frame of the current frame is generic and the signal class of the current frame is voiced, and an algebraic codebook of one subframe in the current frame is different from an algebraic codebook of a previous subframe of the one subframe by a second quantity of times or an algebraic codebook of one subframe in the current frame is different from an algebraic codebook of the previous frame of the current frame by a second quantity of times, performing post-processing on the decoded parameter of the current frame includes adjusting an adaptive codebook gain of a current subframe of the current frame according to at least one of a ratio of an algebraic codebook of the current subframe of the current frame to an algebraic codebook of a neighboring subframe of the current subframe of the current frame, a ratio of an adaptive codebook gain of the current subframe of the current frame to an adaptive codebook gain of the neighboring subframe of the current subframe of the current frame, and a ratio of the algebraic codebook of the current subframe of the current frame to the algebraic codebook of the previous frame of the current frame.

With reference to the first aspect or any one of the first to the ninth implementation manners of the first aspect, in a tenth implementation manner of the first aspect, the decoded parameter of the current frame includes an adaptive codebook gain of the current frame, and when the current frame is a redundancy decoding frame, if the signal class of the next frame of the current frame is unvoiced, the spectral tilt factor of the previous frame of the current frame is less than the preset spectral tilt factor threshold, and an algebraic codebook of at least one subframe of the current frame is 0, performing post-processing on the decoded parameter of the current frame includes using random noise or a non-zero algebraic codebook of the previous subframe of the current subframe of the current frame as an algebraic codebook of an all-0 subframe of the current frame.

With reference to the first aspect or any one of the first to the tenth implementation manners of the first aspect, in an eleventh implementation manner of the first aspect, the current frame is a redundancy decoding frame and the decoded parameter includes a bandwidth extension envelope, and when the current frame is not an unvoiced frame and the next frame of the current frame is an unvoiced frame, if the spectral tilt factor of the previous frame of the current frame is less than the preset spectral tilt factor threshold, performing post-processing on the decoded parameter of the current frame includes performing correction on the bandwidth extension envelope of the current frame according to at least one of a bandwidth extension envelope of the previous frame of the current frame and the spectral tilt factor of the previous frame of the current frame.

With reference to the eleventh implementation manner of the first aspect, in a twelfth implementation manner of the first aspect, a correction factor used when correction is performed on the bandwidth extension envelope of the current frame is inversely proportional to the spectral tilt factor of the previous frame of the current frame and is directly proportional to a ratio of the bandwidth extension envelope of the previous frame of the current frame to the bandwidth extension envelope of the current frame.

With reference to the first aspect or any one of the first to the tenth implementation manners of the first aspect, in a thirteenth implementation manner of the first aspect, the current frame is a redundancy decoding frame and the decoded parameter includes a bandwidth extension envelope, and when the previous frame of the current frame is a normal decoding frame, if the signal class of the current frame is the same as the signal class of the previous frame of the current frame or the current frame is a prediction mode of redundancy decoding, performing post-processing on the decoded parameter of the current frame includes using a bandwidth extension envelope of the previous frame of the current frame to perform adjustment on the bandwidth extension envelope of the current frame.

According to a second aspect, a decoder for decoding a speech/audio bitstream is provided, including a determining unit configured to determine whether a current frame is a normal decoding frame or a redundancy decoding frame, a parsing unit configured to obtain a decoded parameter of the current frame by means of parsing when the determining unit determines that the current frame is a normal decoding frame or a redundancy decoding frame, a post-processing unit configured to perform post-processing on the decoded parameter of the current frame obtained by the parsing unit to obtain a post-processed decoded parameter of the current frame, and a reconstruction unit configured to use the post-processed decoded parameter of the current frame obtained by the post-processing unit to reconstruct a speech/audio signal.

With reference to the second aspect, in a first implementation manner of the second aspect, the post-processing unit is further configured to use the spectral pair parameter of the current frame and a spectral pair parameter of a previous frame of the current frame to obtain a post-processed spectral pair parameters of the current frame when the decoded parameter of the current frame includes a spectral pair parameter of the current frame.

With reference to the first implementation manner of the second aspect, in a second implementation manner of the second aspect, the post-processing unit is further configured to use the following formula to obtain through calculation the post-processed spectral pair parameter of the current frame:

$$lsp[k]=\alpha*\text{lsp_old}[k]+\delta*\text{lsp_new}[k]0\leq k\leq M,$$

where lsp[k] is the post-processed spectral pair parameter of the current frame, lsp_old[k] is the spectral pair parameter of the previous frame, lsp_new[k] is the spectral pair parameter of the current frame, M is an order of spectral pair parameters, $\alpha$ is a weight of the spectral pair parameter of the previous frame, and $\delta$ is a weight of the spectral pair parameter of the current frame, where $\alpha\geq 0$, $\delta\geq 0$, and $\alpha+\delta=1$.

With reference to the first implementation manner of the second aspect, in a third implementation manner of the second aspect, the post-processing unit is further configured to use the following formula to obtain through calculation the post-processed spectral pair parameter of the current frame:

$$lsp[k]=\alpha*\text{lsp_old}[k]+\beta*\text{lsp_mid}[k]+\delta*\text{lsp_new}[k]\quad 0\leq k\leq M,$$

where lsp[k] is the post-processed spectral pair parameter of the current frame, lsp_old[k] is the spectral pair parameter of the previous frame, lsp_mid [k] is a middle value of the spectral pair parameter of the current frame, lsp_new[k] is the spectral pair parameter of the current frame, M is an order of spectral pair parameters, $\alpha$ is a weight of the spectral pair parameter of the previous frame, $\beta$ is a weight of the middle value of the spectral pair parameter of the current frame, and $\delta$ is a weight of the spectral pair parameter of the current frame, where $\alpha\geq 0$, $\beta\geq 0$. $\delta\geq 0$, and $\alpha+\beta+\delta=1$.

With reference to the third implementation manner of the second aspect, in a fourth implementation manner of the second aspect, when the current frame is a redundancy decoding frame and the signal class of the current frame is not unvoiced, if the signal class of the next frame of the current frame is unvoiced, or the spectral tilt factor of the previous frame of the current frame is less than the preset spectral tilt factor threshold, or the signal class of the next frame of the current frame is unvoiced and the spectral tilt factor of the previous frame of the current frame is less than the preset spectral tilt factor threshold, a value of $\beta$ is 0 or is less than a preset threshold.

With reference to any one of the second to the fourth implementation manners of the second aspect, in a fifth implementation manner of the second aspect, when the signal class of the current frame is unvoiced, the previous frame of the current frame is a redundancy decoding frame, and a signal class of the previous frame of the current frame is not unvoiced, a value of $\alpha$ is 0 or is less than a preset threshold.

With reference to any one of the second to the fifth implementation manners of the second aspect, in a sixth implementation manner of the second aspect, when the current frame is a redundancy decoding frame and the signal class of the current frame is not unvoiced, if the signal class of the next frame of the current frame is unvoiced, or the spectral tilt factor of the previous frame of the current frame is less than the preset spectral tilt factor threshold, or the signal class of the next frame of the current frame is unvoiced and the spectral tilt factor of the previous frame of the current frame is less than the preset spectral tilt factor threshold, a value of $\delta$ is 0 or is less than a preset threshold.

With reference to any one of the fourth or the sixth implementation manners of the second aspect, in a seventh implementation manner of the second aspect, the spectral tilt factor may be positive or negative, and a smaller spectral tilt factor indicates a signal class, which is more inclined to be unvoiced, of a frame corresponding to the spectral tilt factor.

With reference to the second aspect or any one of the first to the seventh implementation manners of the second aspect, in an eighth implementation manner of the second aspect, the post-processing unit is further configured to attenuate an adaptive codebook gain of the current subframe of the current frame when the decoded parameter of the current frame includes an adaptive codebook gain of the current frame and the current frame is a redundancy decoding frame, if the next frame of the current frame is an unvoiced frame, or a next frame of the next frame of the current frame is an unvoiced frame and an algebraic codebook of a current subframe of the current frame is a first quantity of times an algebraic codebook of a previous subframe of the current subframe or an algebraic codebook of the previous frame of the current frame.

With reference to the second aspect or any one of the first to the seventh implementation manners of the second aspect, in a ninth implementation manner of the second aspect, the post-processing unit is further configured to, when the decoded parameter of the current frame includes an adaptive codebook gain of the current frame, the current frame or the previous frame of the current frame is a redundancy decoding frame, the signal class of the current frame is generic and the signal class of the next frame of the current frame is voiced or the signal class of the previous frame of the current frame is generic and the signal class of the current frame is voiced, and an algebraic codebook of one subframe in the current frame is different from an algebraic codebook of a previous subframe of the one subframe by a second quantity of times or an algebraic codebook of one subframe in the current frame is different from an algebraic codebook of the previous frame of the current frame by a second quantity of times adjust an adaptive codebook gain of a current subframe of the current frame according to at least one of a ratio of an algebraic codebook of the current subframe of the current frame to an algebraic codebook of a neighboring subframe of the current subframe of the current frame, a ratio of an adaptive codebook gain of the current subframe of the current frame to an adaptive codebook gain of the neighboring subframe of the current subframe of the current frame, and a ratio of the algebraic codebook of the current subframe of the current frame to the algebraic codebook of the previous frame of the current frame.

With reference to the second aspect or any one of the first to the ninth implementation manners of the second aspect, in a tenth implementation manner of the second aspect, the post-processing unit is further configured to use random noise or a non-zero algebraic codebook of the previous subframe of the current subframe of the current frame as an algebraic codebook of an all-0 subframe of the current frame when the decoded parameter of the current frame includes an algebraic codebook of the current frame, the current frame is a redundancy decoding frame, the signal class of the next frame of the current frame is unvoiced, the spectral tilt factor of the previous frame of the current frame is less than the preset spectral tilt factor threshold, and an algebraic codebook of at least one subframe of the current frame is 0.

With reference to the second aspect or any one of the first to the tenth implementation manners of the second aspect, in an eleventh implementation manner of the second aspect, the post-processing unit is further configured to perform correction on the bandwidth extension envelope of the current frame according to at least one of a bandwidth extension envelope of the previous frame of the current frame and the spectral tilt factor of the previous frame of the current frame when the current frame is a redundancy decoding frame and the decoded parameter includes a bandwidth extension envelope, the current frame is not an unvoiced frame and the next frame of the current frame is an unvoiced frame, and the spectral tilt factor of the previous frame of the current frame is less than the preset spectral tilt factor threshold.

With reference to the eleventh implementation manner of the second aspect, in a twelfth implementation manner of the second aspect, a correction factor used when the post-processing unit performs correction on the bandwidth extension envelope of the current frame is inversely proportional to the spectral tilt factor of the previous frame of the current frame and is directly proportional to a ratio of the bandwidth extension envelope of the previous frame of the current frame to the bandwidth extension envelope of the current frame.

With reference to the second aspect or any one of the second or the tenth implementation manners of the second aspect, in a thirteenth implementation manner of the second aspect, the post-processing unit is further configured to use a bandwidth extension envelope of the previous frame of the current frame to perform adjustment on the bandwidth extension envelope of the current frame when the current frame is a redundancy decoding frame, the decoded parameter includes a bandwidth extension envelope, the previous frame of the current frame is a normal decoding frame, and the signal class of the current frame is the same as the signal class of the previous frame of the current frame or the current frame is a prediction mode of redundancy decoding.

According to a third aspect, a decoder for decoding a speech/audio bitstream is provided, including a processor and a memory, where the processor is configured to determine whether a current frame is a normal decoding frame or a redundancy decoding frame, obtain a decoded parameter of the current frame by means of parsing if the current frame is a normal decoding frame or a redundancy decoding frame, perform post-processing on the decoded parameter of the current frame to obtain a post-processed decoded parameter of the current frame, and use the post-processed decoded parameter of the current frame to reconstruct a speech/audio signal.

With reference to the third aspect, in a first implementation manner of the third aspect, the decoded parameter of the current frame includes a spectral pair parameter of the current frame and the processor is configured to use the spectral pair parameter of the current frame and a spectral pair parameter of a previous frame of the current frame to obtain a post-processed spectral pair parameter of the current frame.

With reference to the first implementation manner of the third aspect, in a second implementation manner of the third aspect, the processor is further configured to use the following formula to obtain through calculation the post-processed spectral pair parameter of the current frame:

$$lsp[k]=\alpha*\mathrm{lsp_old}[k]+\delta*\mathrm{lsp_new}[k]\ 0\leq k\leq M,$$

where lsp[k] is the post-processed spectral pair parameter of the current frame, lsp_old[k] is the spectral pair parameter of the previous frame, lsp_new[k] is the spectral pair parameter of the current frame, M is an order of spectral pair parameters, $\alpha$ is a weight of the spectral pair parameter of the previous frame, and $\delta$ is a weight of the spectral pair parameter of the current frame, where $\alpha\geq 0$, $\delta\geq 0$, and $\alpha+\delta=1$.

With reference to the first implementation manner of the third aspect, in a third implementation manner of the third aspect, the processor is further configured to use the following formula to obtain through calculation the post-processed spectral pair parameter of the current frame:

$$lsp[k]=\alpha*\mathrm{lsp_old}[k]+\beta*\mathrm{lsp_mid}[k]+\delta*\mathrm{lsp_new}[k]\ 0\leq k\leq M,$$

where lsp[k] is the post-processed spectral pair parameter of the current frame, lsp_old[k] is the spectral pair parameter of the previous frame, lsp_mid [k] is a middle value of the spectral pair parameter of the current frame, lsp_new[k] is the spectral pair parameter of the current frame, M is an order of spectral pair parameters, $\alpha$ is a weight of the spectral pair parameter of the previous frame, $\beta$ is a weight of the middle value of the spectral pair parameter of the current frame, and $\delta$ is a weight of the spectral pair parameter of the current frame, where $\alpha\geq 0$, $\beta\geq 0$, $\delta\geq 0$, and $\alpha+\beta+\delta=1$.

With reference to the third implementation manner of the third aspect, in a fourth implementation manner of the third aspect, when the current frame is a redundancy decoding frame and the signal class of the current frame is not unvoiced, if the signal class of the next frame of the current frame is unvoiced, or the spectral tilt factor of the previous frame of the current frame is less than the preset spectral tilt factor threshold, or the signal class of the next frame of the current frame is unvoiced and the spectral tilt factor of the previous frame of the current frame is less than the preset spectral tilt factor threshold, a value of $\beta$ is 0 or is less than a preset threshold.

With reference to any one of the second to the fourth implementation manners of the third aspect, in a fifth implementation manner of the third aspect, when the signal class of the current frame is unvoiced, the previous frame of the current frame is a redundancy decoding frame, and a signal class of the previous frame of the current frame is not unvoiced, a value of $\alpha$ is 0 or is less than a preset threshold.

With reference to any one of the second to the fifth implementation manners of the third aspect, in a sixth implementation manner of the third aspect, a value of $\delta$ is 0 or is less than a preset threshold when the current frame is a redundancy decoding frame and the signal class of the current frame is not unvoiced, if the signal class of the next frame of the current frame is unvoiced, or the spectral tilt factor of the previous frame of the current frame is less than the preset spectral tilt factor threshold, or the signal class of the next frame of the current frame is unvoiced and the spectral tilt factor of the previous frame of the current frame is less than the preset spectral tilt factor threshold.

With reference to any one of the fourth or the sixth implementation manners of the third aspect, in a seventh implementation manner of the third aspect, the spectral tilt factor may be positive or negative, and a smaller spectral tilt factor indicates a signal class, which is more inclined to be unvoiced, of a frame corresponding to the spectral tilt factor.

With reference to the third aspect or any one of the first to the seventh implementation manners of the third aspect, in an eighth implementation manner of the third aspect, the decoded parameter of the current frame includes an adaptive codebook gain of the current frame and when the current frame is a redundancy decoding frame, if the next frame of the current frame is an unvoiced frame, or a next frame of the next frame of the current frame is an unvoiced frame and an algebraic codebook of a current subframe of the current frame is a first quantity of times an algebraic codebook of a previous subframe of the current subframe or an algebraic codebook of the previous frame of the current frame, the processor is configured to attenuate an adaptive codebook gain of the current subframe of the current frame.

With reference to the third aspect or any one of the first to the seventh implementation manners of the third aspect, in a ninth implementation manner of the third aspect, the decoded parameter of the current frame includes an adaptive codebook gain of the current frame, and when the current frame or the previous frame of the current frame is a redundancy decoding frame, if the signal class of the current frame is generic and the signal class of the next frame of the current frame is voiced or the signal class of the previous frame of the current frame is generic and the signal class of the current frame is voiced, and an algebraic codebook of one subframe in the current frame is different from an algebraic codebook of a previous subframe of the one subframe by a second quantity of times or an algebraic codebook of one subframe in the current frame is different from an algebraic codebook of the previous frame of the current frame by a second quantity of times, the processor is configured to adjust an adaptive codebook gain of a current subframe of the current frame according to at least one of a ratio of an algebraic codebook of the current subframe of the current frame to an algebraic codebook of a neighboring subframe of the current subframe of the current frame, a ratio of an adaptive codebook gain of the current subframe of the current frame to an adaptive codebook gain of the neighboring subframe of the current subframe of the current frame, and a ratio of the algebraic codebook of the current subframe of the current frame to the algebraic codebook of the previous frame of the current frame.

With reference to the third aspect or any one of the first to the ninth implementation manners of the third aspect, in a tenth implementation manner of the third aspect, the decoded parameter of the current frame includes an algebraic codebook of the current frame, and the processor is further configured to use random noise or a non-zero algebraic codebook of the previous subframe of the current subframe of the current frame as an algebraic codebook of an all-0 subframe of the current frame when the current frame is a redundancy decoding frame, if the signal class of the next frame of the current frame is unvoiced, the spectral tilt factor of the previous frame of the current frame is less than the preset spectral tilt factor threshold, and an algebraic codebook of at least one subframe of the current frame is 0.

With reference to the third aspect or any one of the first to the tenth implementation manners of the third aspect, in an eleventh implementation manner of the third aspect, the current frame is a redundancy decoding frame and the decoded parameter includes a bandwidth extension envelope, and the processor is further configured to perform correction on the bandwidth extension envelope of the current frame according to at least one of a bandwidth extension envelope of the previous frame of the current frame and the spectral tilt factor of the previous frame of the current frame when the current frame is not an unvoiced frame and the next frame of the current frame is an unvoiced frame, if the spectral tilt factor of the previous frame of the current frame is less than the preset spectral tilt factor threshold.

With reference to the eleventh implementation manner of the third aspect, in a twelfth implementation manner of the third aspect, a correction factor used when correction is performed on the bandwidth extension envelope of the current frame is inversely proportional to the spectral tilt factor of the previous frame of the current frame and is directly proportional to a ratio of the bandwidth extension envelope of the previous frame of the current frame to the bandwidth extension envelope of the current frame.

With reference to the third aspect or any one of the first to the tenth implementation manners of the third aspect, in a thirteenth implementation manner of the third aspect, the current frame is a redundancy decoding frame and the decoded parameter includes a bandwidth extension envelope, and the processor is configured to use a bandwidth extension envelope of the previous frame of the current frame to perform adjustment on the bandwidth extension envelope of the current frame when the previous frame of the current frame is a normal decoding frame, if the signal class of the current frame is the same as the signal class of the previous frame of the current frame or the current frame is a prediction mode of redundancy decoding.

In some embodiments of the present application, after obtaining a decoded parameter of a current frame by means of parsing, a decoder side may perform post-processing on the decoded parameter of the current frame and use a post-processed decoded parameter of the current frame to reconstruct a speech/audio signal such that stable quality can be obtained when a decoded signal transitions between a redundancy decoding frame and a normal decoding frame, improving quality of a speech/audio signal that is output.

BRIEF DESCRIPTION OF DRAWINGS

To describe the technical solutions in the embodiments of the present application more clearly, the following briefly introduces the accompanying drawings needed for describing the embodiments. The accompanying drawings in the following description show merely some embodiments of the present application, and a person of ordinary skill in the art may still derive other drawings from these accompanying drawings without creative efforts.

DESCRIPTION OF EMBODIMENTS

To make a person skilled in the art understand the technical solutions in the present application better, the following clearly describes the technical solutions in the embodiments of the present application with reference to the accompanying drawings in the embodiments of the present application. The described embodiments are merely some but not all of the embodiments of the present application. All other embodiments obtained by a person of ordinary skill in the art based on the embodiments of the present application without creative efforts shall fall within the protection scope of the present application.

The following provides respective descriptions in detail.

In the specification, claims, and accompanying drawings of the present application, the terms “first” and “second” are intended to distinguish between similar objects but do not necessarily indicate a specific order or sequence. It should be understood that data termed in such a way is interchangeable in proper circumstances so that the embodiments of the present application described herein can, for example, be implemented in orders other than the order illustrated or described herein. Moreover, the terms "include", "contain" and any other variants mean to cover a non-exclusive inclusion, for example, a process, method, system, product, or device that includes a list of steps or units is not necessarily limited to those steps or units, but may include other steps or units not expressly listed or inherent to such a process, method, system, product, or device.

A method for decoding a speech/audio bitstream provided in this embodiment of the present application is first introduced. The method for decoding a speech/audio bitstream provided in this embodiment of the present application is executed by a decoder. The decoder may be any apparatus that needs to output speeches, for example, a mobile phone, a notebook computer, a tablet computer, or a personal computer.

Figure 1:
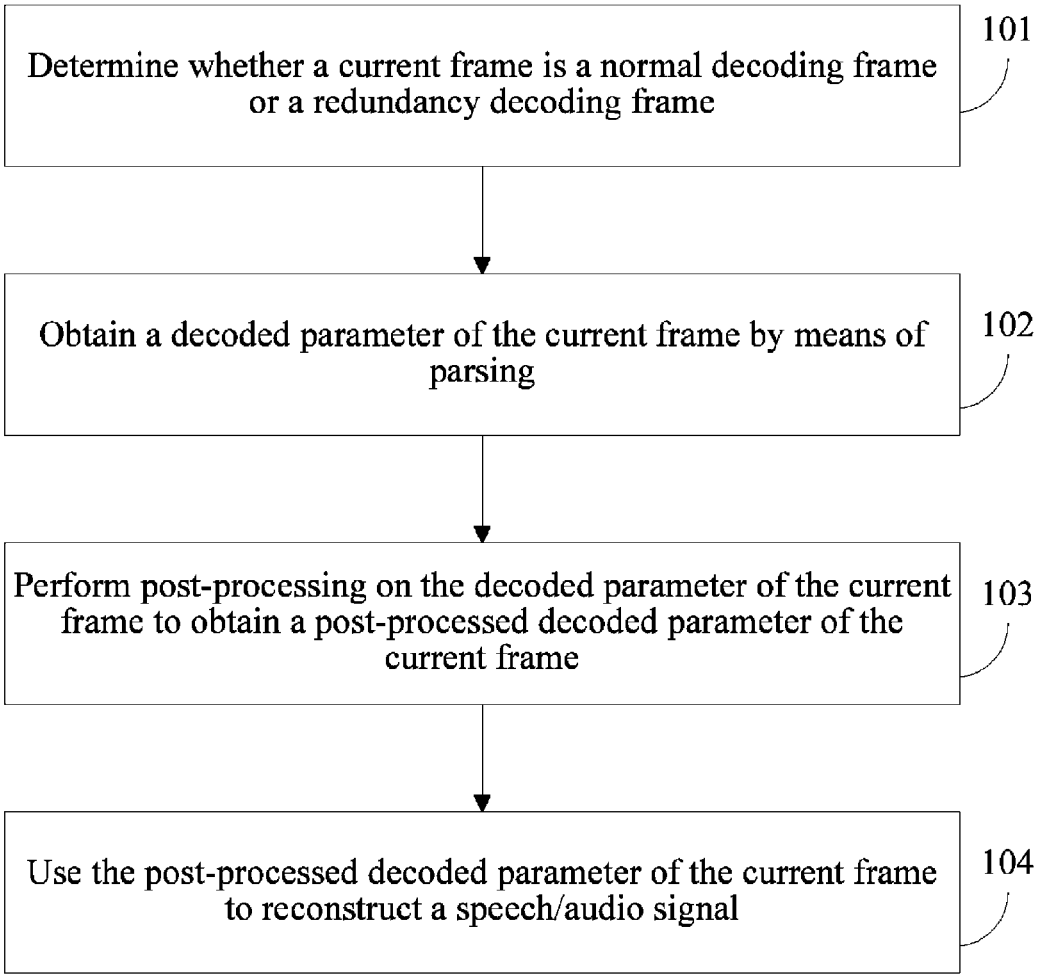
FIG. 1 is a schematic flowchart of a method for decoding a speech/audio bitstream according to an embodiment of the present application.

FIG. 1 describes a procedure of a method for decoding a speech/audio bitstream according to an embodiment of the present application. This embodiment includes the following steps.

Step 101: Determine whether a current frame is a normal decoding frame or a redundancy decoding frame.

A normal decoding frame means that information about a current frame can be obtained directly from a bitstream of the current frame by means of decoding. A redundancy decoding frame means that information about a current frame cannot be obtained directly from a bitstream of the current frame by means of decoding, but redundant bitstream information of the current frame can be obtained from a bitstream of another frame.

In an embodiment of the present application, when the current frame is a normal decoding frame, the method provided in this embodiment of the present application is executed only when a previous frame of the current frame is a redundancy decoding frame. The previous frame of the current frame and the current frame are two immediately neighboring frames. In another embodiment of the present application, when the current frame is a normal decoding frame, the method provided in this embodiment of the present application is executed only when there is a redundancy decoding frame among a particular quantity of frames before the current frame. The particular quantity may be set as needed, for example, may be set to 2, 3, 4, or 10.

Step 102: If the current frame is a normal decoding frame or a redundancy decoding frame, obtain a decoded parameter of the current frame by means of parsing.

The decoded parameter of the current frame may include at least one of a spectral pair parameter, an adaptive codebook gain (gain_pit), an algebraic codebook, and a bandwidth extension envelope, where the spectral pair parameter may be at least one of a linear spectral pair (LSP) parameter and an immittance spectral pair (ISP) parameter. It may be understood that, in this embodiment of the present application, post-processing may be performed on only any, one parameter of decoded parameters or post-processing may be performed on all decoded parameters. Furthermore, how many parameters are selected and which parameters are selected for post-processing may be selected according to application scenarios and environments, which are not limited in this embodiment of the present application.

When the current frame is a normal decoding frame, information about the current frame can be directly obtained from a bitstream of the current frame by means of decoding in order to obtain the decoded parameter of the current frame. When the current frame is a redundancy decoding frame, the decoded parameter of the current frame can be obtained according to redundant bitstream information of the current frame in a bitstream of another frame by means of parsing.

Step 103: Perform post-processing on the decoded parameter of the current frame to obtain a post-processed decoded parameter of the current frame.

For different decoded parameters, different post-processing may be performed. For example, post-processing performed on a spectral pair parameter may be using a spectral pair parameter of the current frame and a spectral pair parameter of a previous frame of the current frame to perform adaptive weighting to obtain a post-processed spectral pair parameter of the current frame. Post-processing performed on an adaptive codebook gain may be performing adjustment, for example, attenuation, on the adaptive codebook gain.

This embodiment of the present application does not impose limitation on specific post-processing. Furthermore, which type of post-processing is performed may be set as needed or according to application environments and scenarios.

Step 104: Use the post-processed decoded parameter of the current frame to reconstruct a speech/audio signal.

It can be known from the above that, in this embodiment, after obtaining a decoded parameter of a current frame by means of parsing, a decoder side may perform post-processing on the decoded parameter of the current frame and use a post-processed decoded parameter of the current frame to reconstruct a speech/audio signal such that stable quality can be obtained when a decoded signal transitions between a redundancy decoding frame and a normal decoding frame, improving quality of a speech/audio signal that is output.

In an embodiment of the present application, the decoded parameter of the current frame includes a spectral pair parameter of the current frame and the performing post-processing on the decoded parameter of the current frame may include using the spectral pair parameter of the current frame and a spectral pair parameter of a previous frame of the current frame to obtain a post-processed spectral pair parameter of the current frame. Furthermore, adaptive weighting is performed on the spectral pair parameter of the current frame and the spectral pair parameter of the previous frame of the current frame to obtain the post-processed spectral pair parameter of the current frame. Furthermore, in an embodiment of the present application, the following formula may be used to obtain through calculation the post-processed spectral pair parameter of the current frame:

$$lsp[k]=\alpha*\mathrm{lsp_old}[k]+\delta*\mathrm{lsp_new}[k]\ 0\le k\le M,$$

where lsp[k] is the post-processed spectral pair parameter of the current frame, lsp_old[k] is the spectral pair parameter of the previous frame, lsp_new[k] is the spectral pair parameter of the current frame, M is an order of spectral pair parameters, $\alpha$ is a weight of the spectral pair parameter of the previous frame, and $\delta$ is a weight of the spectral pair parameter of the current frame, where $\alpha\ge 0$, $\delta\ge 0$, and $\alpha+\delta=1$.

In another embodiment of the present application, the following formula may be used to obtain through calculation the post-processed spectral pair parameter of the current frame:

$$lsp[k]=\alpha*\mathrm{lsp_old}[k]+\beta*\mathrm{lsp_mid}[k]+\delta*\mathrm{lsp_new}[k]\ 0\le k\le M,$$

where lsp[k] is the post-processed spectral pair parameter of the current frame, lsp_old[k] is the spectral pair parameter of the previous frame, lsp_mid [k] is a middle value of the spectral pair parameter of the current frame, lsp__new[k] is the spectral pair parameter of the current frame, M is an order of spectral pair parameters, $\alpha$ is a weight of the spectral pair parameter of the previous frame, $\beta$ is a weight of the middle value of the spectral pair parameter of the current frame, and $\delta$ is a weight of the spectral pair parameter of the current frame, where $\alpha \geq 0$, $\beta \geq 0$, $\delta \geq 0$, and $\alpha+\beta+\delta=1$.

Values of $\alpha$, $\beta$, and $\delta$ in the foregoing formula may vary according to different application environments and scenarios. For example, when a signal class of the current frame is unvoiced, the previous frame of the current frame is a redundancy decoding frame, and a signal class of the previous frame of the current frame is not unvoiced, the value of $\alpha$ is 0 or is less than a preset threshold ($\alpha$_TRESH), where a value of $\alpha$_TRESH may approach 0. When the current frame is a redundancy decoding frame and a signal class of the current frame is not unvoiced, if a signal class of a next frame of the current frame is unvoiced, or a spectral tilt factor of the previous frame of the current frame is less than a preset spectral tilt factor threshold, or a signal class of a next frame of the current frame is unvoiced and a spectral tilt factor of the previous frame of the current frame is less than a preset spectral tilt factor threshold, the value of $\beta$ is 0 or is less than a preset threshold ($\beta$_TRESH), where a value of $\beta$_TRESH may approach 0. When the current frame is a redundancy decoding frame and a signal class of the current frame is not unvoiced, if a signal class of a next frame of the current frame is unvoiced, or a spectral tilt factor of the previous frame of the current frame is less than a preset spectral tilt factor threshold, or a signal class of a next frame of the current frame is unvoiced and a spectral tilt factor of the previous frame of the current frame is less than a preset spectral tilt factor threshold, the value of $\delta$ is 0 or is less than a preset threshold ($\delta$_TRESH), where a value of $\delta$_TRESH may approach 0.

The spectral tilt factor may be positive or negative, and a smaller spectral tilt factor of a frame indicates a signal class, which is more inclined to be unvoiced, of the frame.

The signal class of the current frame may be unvoiced, voiced, generic, transition, inactive, or the like.

Therefore, for a value of the spectral tilt factor threshold, different values may be set according to different application environments and scenarios, for example, may be set to 0.16, 0.15, 0.165, 0.1, 0.161, or 0.159.

In another embodiment of the present application, the decoded parameter of the current frame may include an adaptive codebook gain of the current frame. When the current frame is a redundancy decoding frame, if the next frame of the current frame is an unvoiced frame, or a next frame of the next frame of the current frame is an unvoiced frame and an algebraic codebook of a current subframe of the current frame is a first quantity of times an algebraic codebook of a previous subframe of the current subframe or an algebraic codebook of the previous frame of the current frame, performing post-processing on the decoded parameter of the current frame may include attenuating an adaptive codebook gain of the current subframe of the current frame. When the current frame or the previous frame of the current frame is a redundancy decoding frame, if the signal class of the current frame is generic and the signal class of the next frame of the current frame is voiced or the signal class of the previous frame of the current frame is generic and the signal class of the current frame is voiced, and an algebraic codebook of one subframe in the current frame is different from an algebraic codebook of a previous subframe of the one subframe by a second quantity of times or an algebraic codebook of one subframe in the current frame is different from an algebraic codebook of the previous frame of the current frame by a second quantity of times, performing post-processing on the decoded parameter of the current frame may include adjusting an adaptive codebook gain of a current subframe of the current frame according to at least one of a ratio of an algebraic codebook of the current subframe of the current frame to an algebraic codebook of a neighboring subframe of the current subframe of the current frame, a ratio of an adaptive codebook gain of the current subframe of the current frame to an adaptive codebook gain of the neighboring subframe of the current subframe of the current frame, and a ratio of the algebraic codebook of the current subframe of the current frame to the algebraic codebook of the previous frame of the current frame.

Values of the first quantity and the second quantity may be set according to specific application environments and scenarios. The values may be integers or may be non-integers, where the values of the first quantity and the second quantity may be the same or may be different. For example, the value of the first quantity may be 2, 2.5, 3, 3.4, or 4 and the value of the second quantity may be 2, 2.6, 3, 3.5, or 4.

For an attenuation factor used when the adaptive codebook gain of the current subframe of the current frame is attenuated, different values may be set according to different application environments and scenarios.

In another embodiment of the present application, the decoded parameter of the current frame includes an algebraic codebook of the current frame. When the current frame is a redundancy decoding frame, if the signal class of the next frame of the current frame is unvoiced, the spectral tilt factor of the previous frame of the current frame is less than the preset spectral tilt factor threshold, and an algebraic codebook of at least one subframe of the current frame is 0, performing post-processing on the decoded parameter of the current frame includes using random noise or a non-zero algebraic codebook of the previous subframe of the current subframe of the current frame as an algebraic codebook of an all-0 subframe of the current frame. For the spectral tilt factor threshold, different values may be set according to different application environments or scenarios, for example, may be set to 0.16, 0.15, 0.165, 0.1, 0.161, or 0.159.

In another embodiment of the present application, the decoded parameter of the current frame includes a bandwidth extension envelope of the current frame. When the current frame is a redundancy decoding frame, the current frame is not an unvoiced frame, and the next frame of the current frame is an unvoiced frame, if the spectral tilt factor of the previous frame of the current frame is less than the preset spectral tilt factor threshold, performing post-processing on the decoded parameter of the current frame may include performing correction on the bandwidth extension envelope of the current frame according to at least one of a bandwidth extension envelope of the previous frame of the current frame and the spectral tilt factor. A correction factor used when correction is performed on the bandwidth extension envelope of the current frame is inversely proportional to the spectral tilt factor of the previous frame of the current frame and is directly proportional to a ratio of the bandwidth extension envelope of the previous frame of the current frame to the bandwidth extension envelope of the current frame. For the spectral tilt factor threshold, different values may be set according to different application environments or scenarios, for example, may be set to 0.16, 0.15, 0.165, 0.1, 0.161, or 0.159.

In another embodiment of the present application, the decoded parameter of the current frame includes a bandwidth extension envelope of the current frame. If the current frame is a redundancy decoding frame, the previous frame of the current frame is a normal decoding frame, the signal class of the current frame is the same as the signal class of the previous frame of the current frame or the current frame is a prediction mode of redundancy decoding, performing post-processing on the decoded parameter of the current frame includes using a bandwidth extension envelope of the previous frame of the current frame to perform adjustment on the bandwidth extension envelope of the current frame. The prediction mode of redundancy decoding indicates that, when redundant bitstream information is encoded, more bits are used to encode an adaptive codebook gain part and fewer bits are used to encode an algebraic codebook part or the algebraic codebook part may be even not encoded.

It can be known from the above that, in an embodiment of the present application, at transition between an unvoiced frame and a non-unvoiced frame (when the current frame is an unvoiced frame and a redundancy decoding frame, the previous frame or next frame of the current frame is a non-unvoiced frame and a normal decoding frame, or the current frame is a non-unvoiced frame and a normal decoding frame and the previous frame or next frame of the current frame is an unvoiced frame and a redundancy decoding frame), post-processing may be performed on the decoded parameter of the current frame in order to eliminate a click phenomenon at the inter-frame transition between the unvoiced frame and the non-unvoiced frame, improving quality of a speech/audio signal that is output. In another embodiment of the present application, at transition between a generic frame and a voiced frame (when the current frame is a generic frame and a redundancy decoding frame, the previous frame or next frame of the current frame is a voiced frame and a normal decoding frame, or the current frame is a voiced frame and a normal decoding frame and the previous frame or next frame of the current frame is a generic frame and a redundancy decoding frame), post-processing may be performed on the decoded parameter of the current frame in order to rectify an energy instability phenomenon at the transition between the generic frame and the voiced frame, improving quality of a speech/audio signal that is output. In another embodiment of the present application, when the current frame is a redundancy decoding frame, the current frame is not an unvoiced frame, and the next frame of the current frame is an unvoiced frame, adjustment may be performed on a bandwidth extension envelope of the current frame in order to rectify an energy instability phenomenon in time-domain bandwidth extension, improving quality of a speech/audio signal that is output.

Figure 2:
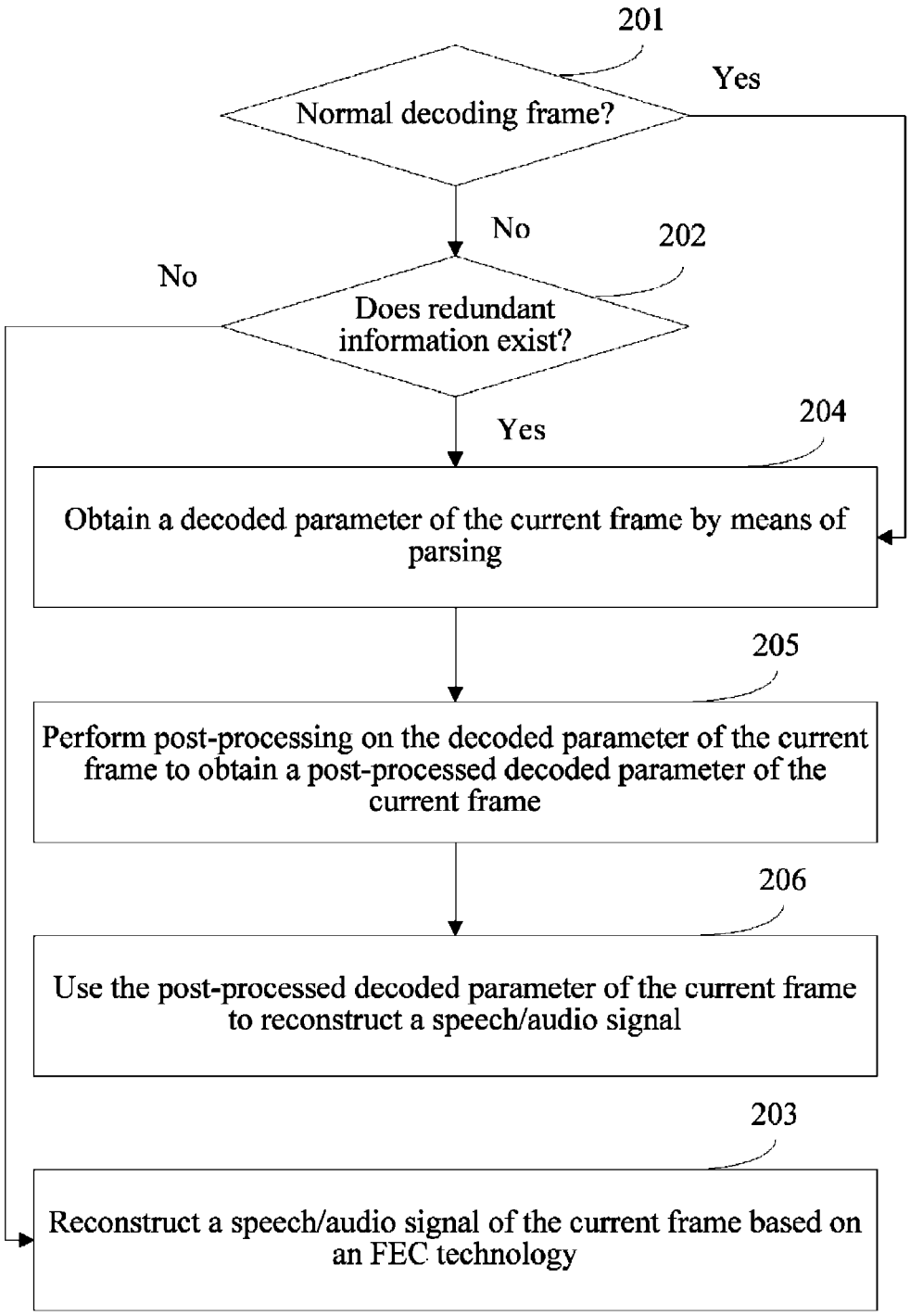
FIG. 2 is a schematic flowchart of a method for decoding a speech/audio bitstream according to another embodiment of the present application.

FIG. 2 describes a procedure of a method for decoding a speech/audio bitstream according to another embodiment of the present application. This embodiment includes the following steps.

Step 201: Determine whether a current frame is a normal decoding frame. If the current frame is a normal decoding frame, perform step 204, and if the current frame is not a normal decoding frame, perform step 202.

Furthermore, whether the current frame is a normal decoding frame may be determined based on a jitter buffer management (JBM) algorithm.

Step 202: Determine whether redundant bitstream information of the current frame exists. If redundant bitstream information of the current frame exists, perform step 204, and if redundant bitstream information of the current frame doesn't exist, perform step 203.

If redundant bitstream information of the current frame exists, the current frame is a redundancy decoding frame. Furthermore, whether redundant bitstream information of the current frame exists may be determined from a jitter buffer or a received bitstream.

Step 203: Reconstruct a speech/audio signal of the current frame based on an FEC technology and end the procedure.

Step 204: Obtain a decoded parameter of the current frame by means of parsing.

When the current frame is a normal decoding frame, information about the current frame can be directly obtained from a bitstream of the current frame by means of decoding in order to obtain the decoded parameter of the current frame. When the current frame is a redundancy decoding frame, the decoded parameter of the current frame can be obtained according to the redundant bitstream information of the current frame by means of parsing.

Step 205: Perform post-processing on the decoded parameter of the current frame to obtain a post-processed decoded parameter of the current frame.

Step 206: Use the post-processed decoded parameter of the current frame to reconstruct a speech/audio signal.

Steps 204 to 206 may be performed by referring to steps 102 to 104, and details are not described herein again.

It can be known from the above that, in this embodiment, after obtaining a decoded parameter of a current frame by means of parsing, a decoder side may perform post-processing on the decoded parameter of the current frame and use a post-processed decoded parameter of the current frame to reconstruct a speech/audio signal such that stable quality can be obtained when a decoded signal transitions between a redundancy decoding frame and a normal decoding frame, improving quality of a speech/audio signal that is output.

In this embodiment of the present application, the decoded parameter of the current frame obtained by parsing by a decoder may include at least one of a spectral pair parameter of the current frame, an adaptive codebook gain of the current frame, an algebraic codebook of the current frame, and a bandwidth extension envelope of the current frame. It may be understood that, even if the decoder obtains at least two of the decoded parameters by means of parsing, the decoder may still perform post-processing on only one of the at least two decoded parameters. Therefore, how many decoded parameters and which decoded parameters the decoder further performs post-processing on may be set according to application environments and scenarios.

The following describes a decoder for decoding a speech/audio bitstream according to an embodiment of the present application. The decoder may be any apparatus that needs to output speeches, for example, a mobile phone, a notebook computer, a tablet computer, or a personal computer.

Figure 3:
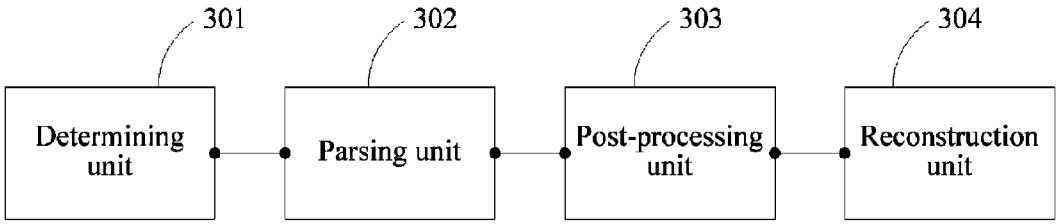
FIG. 3 is a schematic structural diagram of a decoder for decoding a speech/audio bitstream according to an embodiment of the present application.

FIG. 3 describes a structure of a decoder for decoding a speech/audio bitstream according to an embodiment of the present application. The decoder includes a determining unit 301, a parsing unit 302, a post-processing unit 303, and a reconstruction unit 304.

The determining unit 301 is configured to determine whether a current frame is a normal decoding frame.

A normal decoding frame means that information about a current frame can be obtained directly from a bitstream of the current frame by means of decoding. A redundancy decoding frame means that information about a current frame cannot be obtained directly from a bitstream of the current frame by means of decoding, but redundant bitstream information of the current frame can be obtained from a bitstream of another frame.

In an embodiment of the present application, when the current frame is a normal decoding frame, the method provided in this embodiment of the present application is executed only when a previous frame of the current frame is a redundancy decoding frame. The previous frame of the current frame and the current frame are two immediately neighboring frames. In another embodiment of the present application, when the current frame is a normal decoding frame, the method provided in this embodiment of the present application is executed only when there is a redundancy decoding frame among a particular quantity of frames before the current frame. The particular quantity may be set as needed, for example, may be set to 2, 3, 4, or 10.

The parsing unit 302 is configured to obtain a decoded parameter of the current frame by means of parsing when the determining unit 301 determines that the current frame is a normal decoding frame or a redundancy decoding frame.

The decoded parameter of the current frame may include at least one of a spectral pair parameter, an adaptive codebook gain (gain pit), an algebraic codebook, and a bandwidth extension envelope, where the spectral pair parameter may be at least one of an LSP parameter and an ISP parameter. It may be understood that, in this embodiment of the present application, post-processing may be performed on only any, one parameter of decoded parameters or post-processing may be performed on all decoded parameters. Furthermore, how many parameters are selected and which parameters are selected for post-processing may be selected according to application scenarios and environments, which are not limited in this embodiment of the present application.

When the current frame is a normal decoding frame, information about the current frame can be directly obtained from a bitstream of the current frame by means of decoding in order to obtain the decoded parameter of the current frame. When the current frame is a redundancy decoding frame, the decoded parameter of the current frame can be obtained according to redundant bitstream information of the current frame in a bitstream of another frame by means of parsing.

The post-processing unit 303 is configured to perform post-processing on the decoded parameter of the current frame obtained by the parsing unit 302 to obtain a post-processed decoded parameter of the current frame.

For different decoded parameters, different post-processing may be performed. For example, post-processing performed on a spectral pair parameter may be using a spectral pair parameter of the current frame and a spectral pair parameter of a previous frame of the current frame to perform adaptive weighting to obtain a post-processed spectral pair parameter of the current frame. Post-processing performed on an adaptive codebook gain may be performing adjustment, for example, attenuation, on the adaptive codebook gain.

This embodiment of the present application does not impose limitation on specific post-processing. Furthermore, which type of post-processing is performed may be set as needed or according to application environments and scenarios.

The reconstruction unit 304 is configured to use the post-processed decoded parameter of the current frame obtained by the post-processing unit 303 to reconstruct a speech/audio signal.

It can be known from the above that, in this embodiment, after obtaining a decoded parameter of a current frame by means of parsing, a decoder side may perform post-processing on the decoded parameter of the current frame and use a post-processed decoded parameter of the current frame to reconstruct a speech/audio signal such that stable quality can be obtained when a decoded signal transitions between a redundancy decoding frame and a normal decoding frame, improving quality of a speech/audio signal that is output.

In another embodiment of the present application, the decoded parameter includes the spectral pair parameter and the post-processing unit 303 may be further configured to use the spectral pair parameter of the current frame and a spectral pair parameter of a previous frame of the current frame to obtain a post-processed spectral pair parameter of the current frame when the decoded parameter of the current frame includes a spectral pair parameter of the current frame. Furthermore, adaptive weighting is performed on the spectral pair parameter of the current frame and the spectral pair parameter of the previous frame of the current frame to obtain the post-processed spectral pair parameter of the current frame. Furthermore, in an embodiment of the present application, the post-processing unit 303 may use the following formula to obtain through calculation the post-processed spectral pair parameter of the current frame:

$$lsp[k]=\alpha^*\text{lsp_old}[k]+\delta^*\text{lsp_new}[k]\ 0\le k\le M,$$

where lsp[k] is the post-processed spectral pair parameter of the current frame, lsp_old[k] is the spectral pair parameter of the previous frame, lsp_new[k] is the spectral pair parameter of the current frame, M is an order of spectral pair parameters, $\alpha$ is a weight of the spectral pair parameter of the previous frame, and $\delta$ is a weight of the spectral pair parameter of the current frame, where $\alpha\ge 0$ and $\delta\ge 0$.

In an embodiment of the present application, the post-processing unit 303 may use the following formula to obtain through calculation the post-processed spectral pair parameter of the current frame:

$$lsp[k]=\alpha^*\text{lsp_old}[k]+\beta^*\text{lsp_mid}[k]+\delta^*\text{lsp_new}[k]\quad 0\le k\le M,$$

where lsp[k] is the post-processed spectral pair parameter of the current frame, lsp_old[k] is the spectral pair parameter of the previous frame, lsp_mid [k] is a middle value of the spectral pair parameter of the current frame, lsp_new[k] is the spectral pair parameter of the current frame, M is an order of spectral pair parameters, $\alpha$ is a weight of the spectral pair parameter of the previous frame, $\beta$ is a weight of the middle value of the spectral pair parameter of the current frame, and $\delta$ is a weight of the spectral pair parameter of the current frame, where $\alpha\ge 0$, $\beta\ge 0$, and $\delta\ge 0$.

Values of $\alpha$, $\beta$, and $\delta$ in the foregoing formula may vary according to different application environments and scenarios. For example, when a signal class of the current frame is unvoiced, the previous frame of the current frame is a redundancy decoding frame, and a signal class of the previous frame of the current frame is not unvoiced, the value of $\alpha$ is 0 or is less than a preset threshold ($\alpha$_TRESH), where a value of $\alpha$_TRESH may approach 0. When the current frame is a redundancy decoding frame and a signal class of the current frame is not unvoiced, if a signal class of a next frame of the current frame is unvoiced, or a spectral tilt factor of the previous frame of the current frame is less than a preset spectral tilt factor threshold, or a signal class of a next frame of the current frame is unvoiced and a spectral tilt factor of the previous frame of the current frame is less than a preset spectral tilt factor threshold, the value of $\beta$ is 0 or is less than a preset threshold (β_TRESH), where a value of β_TRESH may approach 0. When the current frame is a redundancy decoding frame and a signal class of the current frame is not unvoiced, if a signal class of a next frame of the current frame is unvoiced, or a spectral tilt factor of the previous frame of the current frame is less than a preset spectral tilt factor threshold, or a signal class of a next frame of the current frame is unvoiced and a spectral tilt factor of the previous frame of the current frame is less than a preset spectral tilt factor threshold, the value of δ is 0 or is less than a preset threshold (δ_TRESH), where a value of δ_TRESH may approach 0.

The spectral tilt factor may be positive or negative, and a smaller spectral tilt factor of a frame indicates a signal class, which is more inclined to be unvoiced, of the frame.

The signal class of the current frame may be unvoiced, voiced, generic, transition, inactive, or the like.

Therefore, for a value of the spectral tilt factor threshold, different values may be set according to different application environments and scenarios, for example, may be set to 0.16, 0.15, 0.165, 0.1, 0.161, or 0.159.

In another embodiment of the present application, the post-processing unit 303 is further configured to attenuate an adaptive codebook gain of the current subframe of the current frame when the decoded parameter of the current frame includes an adaptive codebook gain of the current frame and the current frame is a redundancy decoding frame, if the next frame of the current frame is an unvoiced frame, or a next frame of the next frame of the current frame is an unvoiced frame and an algebraic codebook of a current subframe of the current frame is a first quantity of times an algebraic codebook of a previous subframe of the current subframe or an algebraic codebook of the previous frame of the current frame.

For an attenuation factor used when the adaptive codebook gain of the current subframe of the current frame is attenuated, different values may be set according to different application environments and scenarios.

A value of the first quantity may be set according to specific application environments and scenarios. The value may be an integer or may be a non-integer. For example, the value of the first quantity may be 2, 2.5, 3, 3.4, or 4.

In another embodiment of the present application, the post-processing unit 303 is further configured to adjust an adaptive codebook gain of a current subframe of the current frame according to at least one of a ratio of an algebraic codebook of the current subframe of the current frame to an algebraic codebook of a neighboring subframe of the current subframe of the current frame, a ratio of an adaptive codebook gain of the current subframe of the current frame to an adaptive codebook gain of the neighboring subframe of the current subframe of the current frame, and a ratio of the algebraic codebook of the current subframe of the current frame to the algebraic codebook of the previous frame of the current frame when the decoded parameter of the current frame includes an adaptive codebook gain of the current frame, the current frame or the previous frame of the current frame is a redundancy decoding frame, the signal class of the current frame is generic and the signal class of the next frame of the current frame is voiced or the signal class of the previous frame of the current frame is generic and the signal class of the current frame is voiced, and an algebraic codebook of one subframe in the current frame is different from an algebraic codebook of a previous subframe of the one subframe by a second quantity of times or an algebraic codebook of one subframe in the current frame is different from an algebraic codebook of the previous frame of the current frame by a second quantity of times.

A value of the second quantity may be set according to specific application environments and scenarios. The value may be an integer or may be a non-integer. For example, the value of the second quantity may be 2, 2.6, 3, 3.5, or 4.

In another embodiment of the present application, the post-processing unit 303 is further configured to use random noise or a non-zero algebraic codebook of the previous subframe of the current subframe of the current frame as an algebraic codebook of an all-0 subframe of the current frame when the decoded parameter of the current frame includes an algebraic codebook of the current frame, the current frame is a redundancy decoding frame, the signal class of the next frame of the current frame is unvoiced, the spectral tilt factor of the previous frame of the current frame is less than the preset spectral tilt factor threshold, and an algebraic codebook of at least one subframe of the current frame is 0. For the spectral tilt factor threshold, different values may be set according to different application environments or scenarios, for example, may be set to 0.16, 0.15, 0.165, 0.1, 0.161, or 0.159.

In another embodiment of the present application, the post-processing unit 303 is further configured to perform correction on the bandwidth extension of the current frame according to at least one of a bandwidth extension envelope of the previous frame of the current frame and the spectral tilt factor of the previous frame of the current frame when the current frame is a redundancy decoding frame, the decoded parameter includes a bandwidth extension envelope, the current frame is not an unvoiced frame and the next frame of the current frame is an unvoiced frame, and the spectral tilt factor of the previous frame of the current frame is less than the preset spectral tilt factor threshold. A correction factor used when correction is performed on the bandwidth extension envelope of the current frame is inversely proportional to the spectral tilt factor of the previous frame of the current frame and is directly proportional to a ratio of the bandwidth extension envelope of the previous frame of the current frame to the bandwidth extension envelope of the current frame. For the spectral tilt factor threshold, different values may be set according to different application environments or scenarios, for example, may be set to 0.16, 0.15, 0.165, 0.1, 0.161, or 0.159.

In another embodiment of the present application, the post-processing unit 303 is further configured to use a bandwidth extension envelope of the previous frame of the current frame to perform adjustment on the bandwidth extension envelope of the current frame when the current frame is a redundancy decoding frame, the decoded parameter includes a bandwidth extension envelope, the previous frame of the current frame is a normal decoding frame, and the signal class of the current frame is the same as the signal class of the previous frame of the current frame or the current frame is a prediction mode of redundancy decoding.

It can be known from the above that, in an embodiment of the present application, at transition between an unvoiced frame and a non-unvoiced frame (when the current frame is an unvoiced frame and a redundancy decoding frame, the previous frame or next frame of the current frame is a non-unvoiced frame and a normal decoding frame, or the current frame is a non-unvoiced frame and a normal decoding frame and the previous frame or next frame of the current frame is an unvoiced frame and a redundancy decoding frame), post-processing may be performed on the decoded parameter of the current frame in order to eliminate a click phenomenon at the inter-frame transition between the unvoiced frame and the non-unvoiced frame, improving quality of a speech/audio signal that is output. In another embodiment of the present application, at transition between a generic frame and a voiced frame (when the current frame is a generic frame and a redundancy decoding frame, the previous frame or next frame of the current frame is a voiced frame and a normal decoding frame, or the current frame is a voiced frame and a normal decoding frame and the previous frame or next frame of the current frame is a generic frame and a redundancy decoding frame), post-processing may be performed on the decoded parameter of the current frame in order to rectify an energy instability phenomenon at the transition between the generic frame and the voiced frame, improving quality of a speech/audio signal that is output. In another embodiment of the present application, when the current frame is a redundancy decoding frame, the current frame is not an unvoiced frame, and the next frame of the current frame is an unvoiced frame, adjustment may be performed on a bandwidth extension envelope of the current frame in order to rectify an energy instability phenomenon in time-domain bandwidth extension, improving quality of a speech/audio signal that is output.

Figure 4:
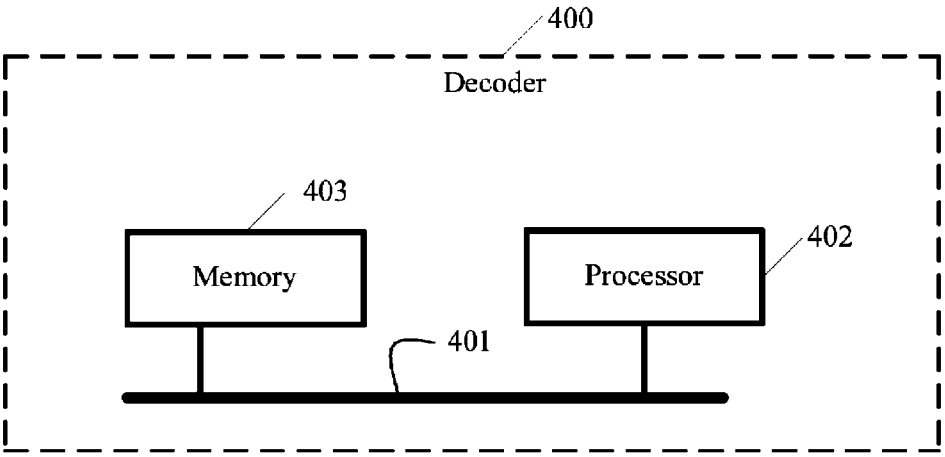
FIG. 4 is a schematic structural diagram of a decoder for decoding a speech/audio bitstream according to an embodiment of the present application.

FIG. 4 describes a structure of a decoder 400 for decoding a speech/audio bitstream according to another embodiment of the present application. The decoder 400 includes at least one bus 401, at least one processor 402 connected to the bus 401, and at least one memory 403 connected to the bus 401.

The processor 402 invokes a code stored in the memory 403 using the bus 401 in order to determine whether a current frame is a normal decoding frame or a redundancy decoding frame, obtain a decoded parameter of the current frame by means of parsing if the current frame is a normal decoding frame or a redundancy decoding frame, perform post-processing on the decoded parameter of the current frame to obtain a post-processed decoded parameter of the current frame, and use the post-processed decoded parameter of the current frame to reconstruct a speech/audio signal.

It can be known from the above that, in this embodiment, after obtaining a decoded parameter of a current frame by means of parsing, a decoder side may perform post-processing on the decoded parameter of the current frame and use a post-processed decoded parameter of the current frame to reconstruct a speech/audio signal such that stable quality can be obtained when a decoded signal transitions between a redundancy decoding frame and a normal decoding frame, improving quality of a speech/audio signal that is output.

In an embodiment of the present application, the decoded parameter of the current frame includes a spectral pair parameter of the current frame and the processor 402 invokes the code stored in the memory 403 using the bus 401 in order to use the spectral pair parameter of the current frame and a spectral pair parameter of a previous frame of the current frame to obtain a post-processed spectral pair parameter of the current frame. Furthermore, adaptive weighting is performed on the spectral pair parameter of the current frame and the spectral pair parameter of the previous frame of the current frame to obtain the post-processed spectral pair parameter of the current frame. Further, in an embodiment of the present application, the following formula may be used to obtain through calculation the post-processed spectral pair parameter of the current frame:

$$lsp[k]=\alpha^*\text{lsp_old}[k]+\delta^*\text{lsp_new}[k]0\le k\le M,$$

where lsp[k] is the post-processed spectral pair parameter of the current frame, lsp_new[k] is the spectral pair parameter of the previous frame, M is an order of spectral pair parameters, $\alpha$ is a weight of the spectral pair parameter of the previous frame, and $\delta$ is a weight of the spectral pair parameter of the current frame, where $\alpha\ge0$ and $\delta\ge0$.

In another embodiment of the present application, the following formula may be used to obtain through calculation the post-processed spectral pair parameter of the current frame:

$$lsp[k]=\alpha^*\text{lsp_old}[k]+\beta^*\text{lsp_mid}[k]+\delta^*\text{lsp_new}[k]\quad 0\le k\le M,$$

where lsp[k] is the post-processed spectral pair parameter of the current frame, lsp_old[k] is the spectral pair parameter of the previous frame, lsp_mid [k] is a middle value of the spectral pair parameter of the current frame, lsp_new[k] is the spectral pair parameter of the current frame, M is an order of spectral pair parameters, $\alpha$ is a weight of the spectral pair parameter of the previous frame, $\beta$ is a weight of the middle value of the spectral pair parameter of the current frame, and $\delta$ is a weight of the spectral pair parameter of the current frame, where $\alpha\ge0$, $\beta\ge0$, and $\delta\ge0$.

Values of $\alpha$, $\beta$, and $\delta$ in the foregoing formula may vary according to different application environments and scenarios. For example, when a signal class of the current frame is unvoiced, the previous frame of the current frame is a redundancy decoding frame, and a signal class of the previous frame of the current frame is not unvoiced, the value of $\alpha$ is 0 or is less than a preset threshold ($\alpha$_TRESH), where a value of $\alpha$_TRESH may approach 0. When the current frame is a redundancy decoding frame and a signal class of the current frame is not unvoiced, if a signal class of a next frame of the current frame is unvoiced, or a spectral tilt factor of the previous frame of the current frame is less than a preset spectral tilt factor threshold, or a signal class of a next frame of the current frame is unvoiced and a spectral tilt factor of the previous frame of the current frame is less than a preset spectral tilt factor threshold, the value of $\beta$ is 0 or is less than a preset threshold ($\beta$_TRESH), where a value of $\beta$_TRESH may approach 0. When the current frame is a redundancy decoding frame and a signal class of the current frame is not unvoiced, if a signal class of a next frame of the current frame is unvoiced, or a spectral tilt factor of the previous frame of the current frame is less than a preset spectral tilt factor threshold, or a signal class of a next frame of the current frame is unvoiced and a spectral tilt factor of the previous frame of the current frame is less than a preset spectral tilt factor threshold, the value of $\delta$ is 0 or is less than a preset threshold ($\delta$_TRESH), where a value of $\delta$_TRESH may approach 0.

The spectral tilt factor may be positive or negative, and a smaller spectral tilt factor of a frame indicates a signal class, which is more inclined to be unvoiced, of the frame.

The signal class of the current frame may be unvoiced, voiced, generic, transition, inactive, or the like.

Therefore, for a value of the spectral tilt factor threshold, different values may be set according to different application environments and scenarios, for example, may be set to 0.16, 0.15, 0.165, 0.1, 0.161, or 0.159.

In another embodiment of the present application, the decoded parameter of the current frame may include an adaptive codebook gain of the current frame. When the current frame is a redundancy decoding frame, if the next frame of the current frame is an unvoiced frame, or a next frame of the next frame of the current frame is an unvoiced frame and an algebraic codebook of a current subframe of the current frame is a first quantity of times an algebraic codebook of a previous subframe of the current subframe or an algebraic codebook of the previous frame of the current frame, the processor 402 invokes the code stored in the memory 403 using the bus 401 in order to attenuate an adaptive codebook gain of the current subframe of the current frame. When the current frame or the previous frame of the current frame is a redundancy decoding frame, if the signal class of the current frame is generic and the signal class of the next frame of the current frame is voiced or the signal class of the previous frame of the current frame is generic and the signal class of the current frame is voiced, and an algebraic codebook of one subframe in the current frame is different from an algebraic codebook of a previous subframe of the one subframe by a second quantity of times or an algebraic codebook of one subframe in the current frame is different from an algebraic codebook of the previous frame of the current frame by a second quantity of times, performing post-processing on the decoded parameter of the current frame may include adjusting an adaptive codebook gain of a current subframe of the current frame according to at least one of a ratio of an algebraic codebook of the current subframe of the current frame to an algebraic codebook of a neighboring subframe of the current subframe of the current frame, a ratio of an adaptive codebook gain of the current subframe of the current frame to an adaptive codebook gain of the neighboring subframe of the current subframe of the current frame, and a ratio of the algebraic codebook of the current subframe of the current frame to the algebraic codebook of the previous frame of the current frame.

Values of the first quantity and the second quantity may be set according to specific application environments and scenarios. The values may be integers or may be non-integers, where the values of the first quantity and the second quantity may be the same or may be different. For example, the value of the first quantity may be 2, 2.5, 3, 3.4, or 4 and the value of the second quantity may be 2, 2.6, 3, 3.5, or 4.

For an attenuation factor used when the adaptive codebook gain of the current subframe of the current frame is attenuated, different values may be set according to different application environments and scenarios.

In another embodiment of the present application, the decoded parameter of the current frame includes an algebraic codebook of the current frame. When the current frame is a redundancy decoding frame, if the signal class of the next frame of the current frame is unvoiced, the spectral tilt factor of the previous frame of the current frame is less than the preset spectral tilt factor threshold, and an algebraic codebook of at least one subframe of the current frame is 0, the processor 402 invokes the code stored in the memory 403 using the bus 401 in order to use random noise or a non-zero algebraic codebook of the previous subframe of the current subframe of the current frame as an algebraic codebook of an all-0 subframe of the current frame. For the spectral tilt factor threshold, different values may be set according to different application environments or scenarios, for example, may be set to 0.16, 0.15, 0.165, 0.1, 0.161, or 0.159.

In another embodiment of the present application, the decoded parameter of the current frame includes a bandwidth extension envelope of the current frame. When the current frame is a redundancy decoding frame, the current frame is not an unvoiced frame, and the next frame of the current frame is an unvoiced frame, if the spectral tilt factor of the previous frame of the current frame is less than the preset spectral tilt factor threshold, the processor 402 invokes the code stored in the memory 403 using the bus 401 in order to perform correction on the bandwidth extension envelope of the current frame according to at least one of a bandwidth extension envelope of the previous frame of the current frame and the spectral tilt factor of the previous frame of the current frame. A correction factor used when correction is performed on the bandwidth extension envelope of the current frame is inversely proportional to the spectral tilt factor of the previous frame of the current frame and is directly proportional to a ratio of the bandwidth extension envelope of the previous frame of the current frame to the bandwidth extension envelope of the current frame. For the spectral tilt factor threshold, different values may be set according to different application environments or scenarios, for example, may be set to 0.16, 0.15, 0.165, 0.1, 0.161, or 0.159.

In another embodiment of the present application, the decoded parameter of the current frame includes a bandwidth extension envelope of the current frame. If the current frame is a redundancy decoding frame, the previous frame of the current frame is a normal decoding frame, the signal class of the current frame is the same as the signal class of the previous frame of the current frame or the current frame is a prediction mode of redundancy decoding, the processor 402 invokes the code stored in the memory 403 using the bus 401 in order to use a bandwidth extension envelope of the previous frame of the current frame to perform adjustment on the bandwidth extension envelope of the current frame.

It can be known from the above that, in an embodiment of the present application, at transition between an unvoiced frame and a non-unvoiced frame (when the current frame is an unvoiced frame and a redundancy decoding frame, the previous frame or next frame of the current frame is a non-unvoiced frame and a normal decoding frame, or the current frame is a non-unvoiced frame and a normal decoding frame and the previous frame or next frame of the current frame is an unvoiced frame and a redundancy decoding frame), post-processing may be performed on the decoded parameter of the current frame in order to eliminate a click phenomenon at the inter-frame transition between the unvoiced frame and the non-unvoiced frame, improving quality of a speech/audio signal that is output. In another embodiment of the present application, at transition between a generic frame and a voiced frame (when the current frame is a generic frame and a redundancy decoding frame, the previous frame or next frame of the current frame is a voiced frame and a normal decoding frame, or the current frame is a voiced frame and a normal decoding frame and the previous frame or next frame of the current frame is a generic frame and a redundancy decoding frame), post-processing may be performed on the decoded parameter of the current frame in order to rectify an energy instability phenomenon at the transition between the generic frame and the voiced frame, improving quality of a speech/audio signal that is output. In another embodiment of the present application, when the current frame is a redundancy decoding frame, the current frame is not an unvoiced frame, and the next frame of the current frame is an unvoiced frame, adjustment may be performed on a bandwidth extension envelope of the current frame in order to rectify an energy instability phenomenon in time-domain bandwidth extension, improving quality of a speech/audio signal that is output.

An embodiment of the present application further provides a computer storage medium. The computer storage medium may store a program and the program performs some or all steps of the method for decoding a speech/audio bitstream that are described in the foregoing method embodiments.

It should be noted that, for brief description, the foregoing method embodiments are represented as series of actions. However, a person skilled in the art should appreciate that the present application is not limited to the described order of the actions, because according to the present application, some steps may be performed in other orders or simultaneously. In addition, a person skilled in the art should also understand that all the embodiments described in this specification are exemplary embodiments, and the involved actions and modules are not necessarily mandatory to the present application.

In the foregoing embodiments, the description of each embodiment has a respective focus. For a part that is not described in detail in one embodiment, reference may be made to related descriptions in other embodiments.

In the several embodiments provided in the present application, it should be understood that the disclosed apparatus may be implemented in other manners. For example, the described apparatus embodiments are merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented using some interfaces. The indirect couplings or communication connections between the apparatuses or units may be implemented in electronic or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present application may be integrated into one processing unit, or each of the units may exist alone physically, or two or more units are integrated into one unit. The integrated unit may be implemented in a form of hardware, or may be implemented in a form of a software functional unit.

When the foregoing integrated unit is implemented in the form of a software functional unit and sold or used as an independent product, the integrated unit may be stored in a computer-readable storage medium. Based on such an understanding, the technical solutions of the present application essentially, or the part contributing to the prior art, or all or some of the technical solutions may be implemented in a form of a software product. The computer software product is stored in a storage medium and includes several instructions for instructing a computer device (which may be a personal computer, a server, a network device, or a processor connected to a memory) to perform all or some of the steps of the methods described in the foregoing embodiments of the present application. The foregoing storage medium includes any medium that can store program code, such as a universal serial bus (USB) flash drive, a read-only memory (ROM), a random access memory (RAM), a portable hard drive, a magnetic disk, or an optical disc.

The foregoing embodiments are merely intended to describe the technical solutions of the present application, but not to limit the present application. Although the present application is described in detail with reference to the foregoing embodiments, persons of ordinary skill in the art should understand that they may still make modifications to the technical solutions described in the foregoing embodiments or make equivalent replacements to some technical features thereof, without departing from the scope of the technical solutions of the embodiments of the present application.

What is claimed is:

1. A method for decoding a speech/audio bitstream, comprising:

performing decoding operations on a bit stream, wherein a decoded parameter of a first frame and a decoded parameter of a second frame are acquired via the decoding operations, and wherein the second frame is a previous frame adjacent to the first frame;

performing, according to the decoded parameter of the second frame, post-processing on the decoded parameter of the first frame to obtain a post-processed decoded parameter of the first frame when at least one of the first frame or the second frame is a redundancy decoding frame; and reconstructing a speech/audio signal using the post-processed decoded parameter of the first frame, wherein the decoded parameter of the first frame comprises a spectral pair parameter of the first frame, wherein the decoded parameter of the second frame comprises a spectral pair parameter of the second frame, and wherein performing post-processed on the decoded parameter of the first frame comprises weighting the spectral pair parameter of the first frame and the spectral pair parameter of the second frame.

2. The method according to claim 1, wherein the post-processed spectral pair parameter of the first frame is obtained through calculation using the formula $lsp[k]=\alpha*lsp_old[k]+\beta*lsp_mid[k]+\delta*lsp_new[k]$, wherein $0 \leq k \leq M$ wherein lsp[k] is the post-processed spectral pair parameter of the first frame, wherein lsp_old[k]is the spectral pair parameter of the second frame, wherein lsp_mid[k] is a middle value of the spectral pair parameter of the first frame, wherein lsp_new[k] is the spectral pair parameter of the first frame, wherein M is an order of spectral pair parameters, wherein $\alpha$ is a weight of the spectral pair parameter of the second frame, wherein $\beta$ is a weight of the middle value of the spectral pair parameter of the first frame, wherein $\delta$ is a weight of the spectral pair parameter of the first frame, wherein $\alpha \geq 0$, wherein $\beta \geq 0$, wherein $\delta \geq 0$, and wherein $\alpha+\beta+\delta=1$.

3. The method according to claim 2, wherein a value of $\beta$ is 0 or is less than a preset threshold when the first frame is the redundancy decoding frame, a signal class of the first frame is not unvoiced, and a signal class of a next frame of the first frame is unvoiced.

4. The method according to claim 2, wherein a value of $\beta$ is 0 or is less than a preset threshold when the first frame is the redundancy decoding frame, a signal class of the first frame is not unvoiced, and a spectral tilt factor of the second frame is less than a preset spectral tilt factor threshold.

5. The method according to claim 2, wherein a value of $\beta$ is 0 or is less than a preset threshold when the first frame is the redundancy decoding frame, a signal class of the first frame is not unvoiced, a signal class of a next frame of the first frame is unvoiced, and a spectral tilt factor of the second frame is less than a preset spectral tilt factor threshold.

6. The method according to claim 1, wherein a weight of the spectral pair parameter of the second frame is 0 or less than a preset threshold when a signal class of the first frame is unvoiced, the second frame is the redundancy decoding frame, and a signal class of the second frame is not unvoiced.

7. The method according to claim 1, wherein a weight of the spectral pair parameter of the first frame is 0 or is less than a preset threshold when the first frame is the redundancy decoding frame, a signal class of the first frame is not unvoiced, and a signal class of a next frame of the first frame is unvoiced.

8. The method according to claim 1, a weight of the spectral pair parameter of the first frame is 0 or is less than a preset threshold when the first frame is the redundancy decoding frame, a signal class of the first frame is not unvoiced, and a spectral tilt factor of the second frame is less than a preset spectral tilt factor threshold.

9. The method according to claim 1, wherein a weight of the spectral pair parameter of the first frame is 0 or is less than a preset threshold when the first frame is the redundancy decoding frame, a signal class of the first frame is not unvoiced, a signal class of a next frame of the first frame is unvoiced and a spectral tilt factor of the second frame is less than a preset spectral tilt factor threshold.

10. The method according to claim 4, wherein a smaller spectral tilt factor indicates the signal class, which is more inclined to be unvoiced, of a frame corresponding to the spectral tilt factor.

11. The method according to claim 1, wherein the decoded parameter of the first frame comprises an adaptive codebook gain and wherein performing the post-processing on the decoded parameter of the first frame comprises attenuating an adaptive codebook gain of at least one subframe of the first frame when the first frame is the redundancy decoding frame and a next frame of the first frame is an unvoiced frame.

12. The method according to claim 1, wherein the first frame is the redundancy decoding frame, wherein the decoded parameter comprises a bandwidth extension envelope, and wherein performing the post-processing on the decoded parameter of the first frame comprises performing correction on the bandwidth extension envelope of the first frame according to at least one of a bandwidth extension envelope of the second frame or the spectral tilt factor of the second frame when the first frame is not an unvoiced frame, a next frame of the first frame is an unvoiced frame, and a spectral tilt factor of the second frame is less than a preset spectral tilt factor threshold.

13. The method according to claim 12, wherein a correction factor used when correction is performed on the bandwidth extension envelope of the first frame is inversely proportional to the spectral tilt factor of the second frame and is directly proportional to a ratio of the bandwidth extension envelope of the second frame to the bandwidth extension envelope of the first frame.

14. The method according to claim 1, wherein the first frame is the redundancy decoding frame, wherein the decoded parameter comprises a bandwidth extension envelope, and wherein performing the post-processing on the decoded parameter of the first frame comprises using a bandwidth extension envelope of the second frame to perform adjustment on a bandwidth extension envelope of the first frame when the second frame is a normal decoding frame, and a signal class of the first frame is same as a signal class of the second frame.

15. A decoder for decoding a speech/audio bitstream, comprising:

a processor; and a memory coupled to the processor, wherein the processor is configured to:

perform decoding operations on a bit stream, wherein a decoded parameter of a first frame and a decoded of a second frame are acquired via the decoding operations, and wherein the second frame is a previous frame adjacent to the first frame:

perform post-processing on the decoded parameter of the first frame to obtain a post-processed decoded parameter of the first frame when at least one of the first frame or the second frame is a redundancy decoding frame; and reconstruct a speech/audio signal using the post-processed decoded parameter of the first frame wherein the decoded parameter of the first frame comprises a spectral pair parameter of the first frame, wherein the decoded parameter of the second frame comprises a spectral pair parameter of the second frame, and wherein the post-processed decoded parameter of the first frame is calculated by weighting the spectral pair parameter of the first frame and the spectral pair parameter of the second frame.

16. A non-transitory computer-readable storage medium storing computer instructions, that when executed by one or more processors, cause the one or more processors to perform decoding operations on a bit stream, wherein a decoded parameter of a first frame and a decoded parameter of a second frame are acquired via the decoding operations, and wherein the second frame is a previous frame adjacent to the first frame:, perform post-processing on the decoded parameter of the first frame to obtain a post-processed decoded parameter of the first frame when at least one of the first frame or the second frame is a redundancy decoding frame; and reconstruct a speech/audio signal using the post-processed decoded parameter of the first frame wherein the decoded parameter of the first frame comprises a spectral pair parameter of the first frame, wherein the decoded parameter of the second frame comprises a spectral pair parameter of the second frame, and wherein the post-processed decoded parameter of the first frame is calculated by weighting the spectral pair parameter of the first frame and the spectral pair parameter of the second frame.

* * * * *